US007064287B2

(12) United States Patent
Kameda

(10) Patent No.: US 7,064,287 B2
(45) Date of Patent: Jun. 20, 2006

(54) PUSH BUTTON SWITCH FOR VEHICLE

(75) Inventor: Mitsuaki Kameda, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/031,002

(22) Filed: Jan. 10, 2005

(65) Prior Publication Data

US 2005/0161314 A1 Jul. 28, 2005

(30) Foreign Application Priority Data

Jan. 23, 2004 (JP) ..... 2004-015492

(51) Int. Cl.
*H01H 3/12* (2006.01)

(52) U.S. Cl. ..... 200/341; 200/345

(58) Field of Classification Search ..... 200/5 R, 200/5 A, 310–314, 341–345, 512–517
See application file for complete search history.

(56) References Cited

U.S. PATENT DOCUMENTS 5,384,442 A 1/1995 Danner
5,493,087 A * 2/1996 Yoshida et al. ..... 200/302.2
6,333,478 B1 * 12/2001 Altmann ..... 200/520
6,809,278 B1 * 10/2004 Tsubaki ..... 200/341
2002/0157935 A1 10/2002 Bonn et al.
2003/0214381 A1 11/2003 Pan
2004/0182687 A1 * 9/2004 Tsubaki ..... 200/341

FOREIGN PATENT DOCUMENTS

DE 33 36 878 A1 5/1985
EP 0 238 899 A1 9/1987
JP 11-144560 A 5/1999
JP 2000-311544 A 11/2000

* cited by examiner

*Primary Examiner*—Michael Friedhofer
*Assistant Examiner*—Lisa Klaus
(74) *Attorney, Agent, or Firm*—Foley & Lardner LLP

(57) ABSTRACT

A push button switch for a vehicle is provided with a cylinder portion, a button portion slidably fitted in the cylinder portion and one or more resilient pieces interposed between an inner surface of the cylinder portion and a circumferential surface of the button portion. The resilient pieces are configured to prevent unsteadiness of the button portion in a sliding direction and a swinging direction.

7 Claims, 4 Drawing Sheets

PUSH BUTTON SWITCH FOR VEHICLE

BACKGROUND OF THE INVENTION

1. Field of the Invention

The present invention relates to a push button switch preferably applied to a vehicle.

2. Description of the Related Art

A vehicle is provided with a plurality of switches for operation of various instruments. A type of such switches is a tubular rotary switch, which is provided with a rotary switch and a push button fitted inside of the rotary switch. An operator may select functions by combination of respective operations of the rotary switch and the push button.

In the conventional tubular rotary switch the dimensional tolerance of elements that constitute the tubular rotary switch is a technical problem, since errors of sizes cause lack of smoothness, unsteadiness and inoperability of the push button.

SUMMARY

The present invention is provides a push button switch, which is free of unsteadiness and has an easy operability, though the dimensional tolerance is easy to be managed.

According to an aspect of the invention, a push button switch for a vehicle is provided with a cylinder portion; a button portion slidably fitted in the cylinder portion; and one or more resilient pieces interposed between an inner surface of the cylinder portion and a circumferential surface of the button portion, the resilient pieces being configured to prevent unsteadiness of the button portion in a sliding direction and a swinging direction.

Preferably, the resilient pieces are formed on the circumferential surface of the button portion and respectively provided with sloping surfaces configured to slide on the inner surface of the cylinder portion and center the button portion with respect to the cylinder portion.

More preferably, the button portion is provided with one or more latching projections at a proximal end and the latching projections are configured to engage with the inner surface of the cylinder portion.

Still preferably, the resilient pieces and the latching projections are respectively aligned along the sliding direction of the button portion.

DETAILED DESCRIPTION OF THE PREFERRED EMBODIMENT

An embodiment of the present invention will described hereinafter with reference to FIGS. 1 through 6.

Figure 1:
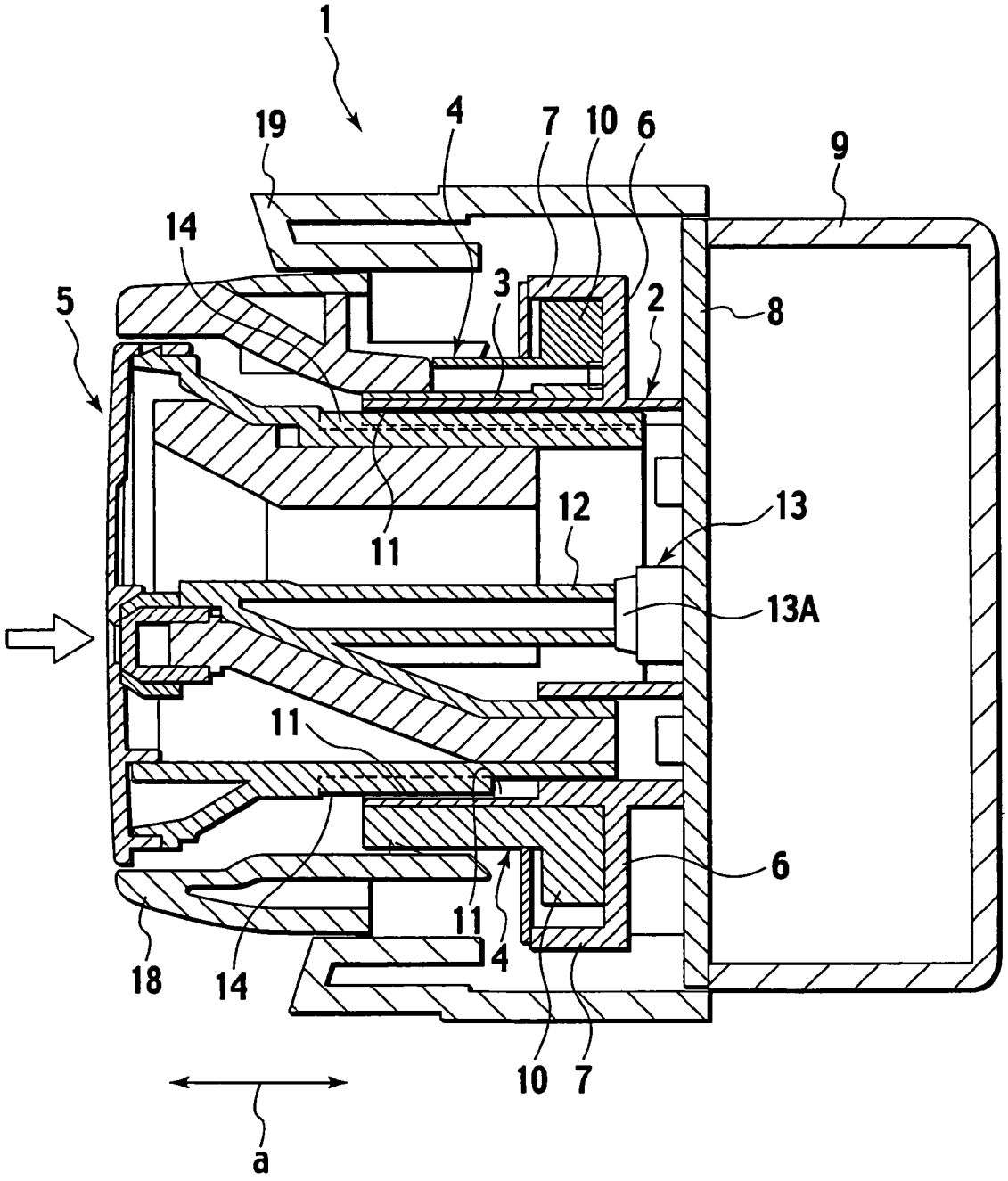
FIG. 1 is a cross sectional view of a push button switch, which is taken from a section including a center thereof, according to an embodiment of the present invention.
Figure 2:
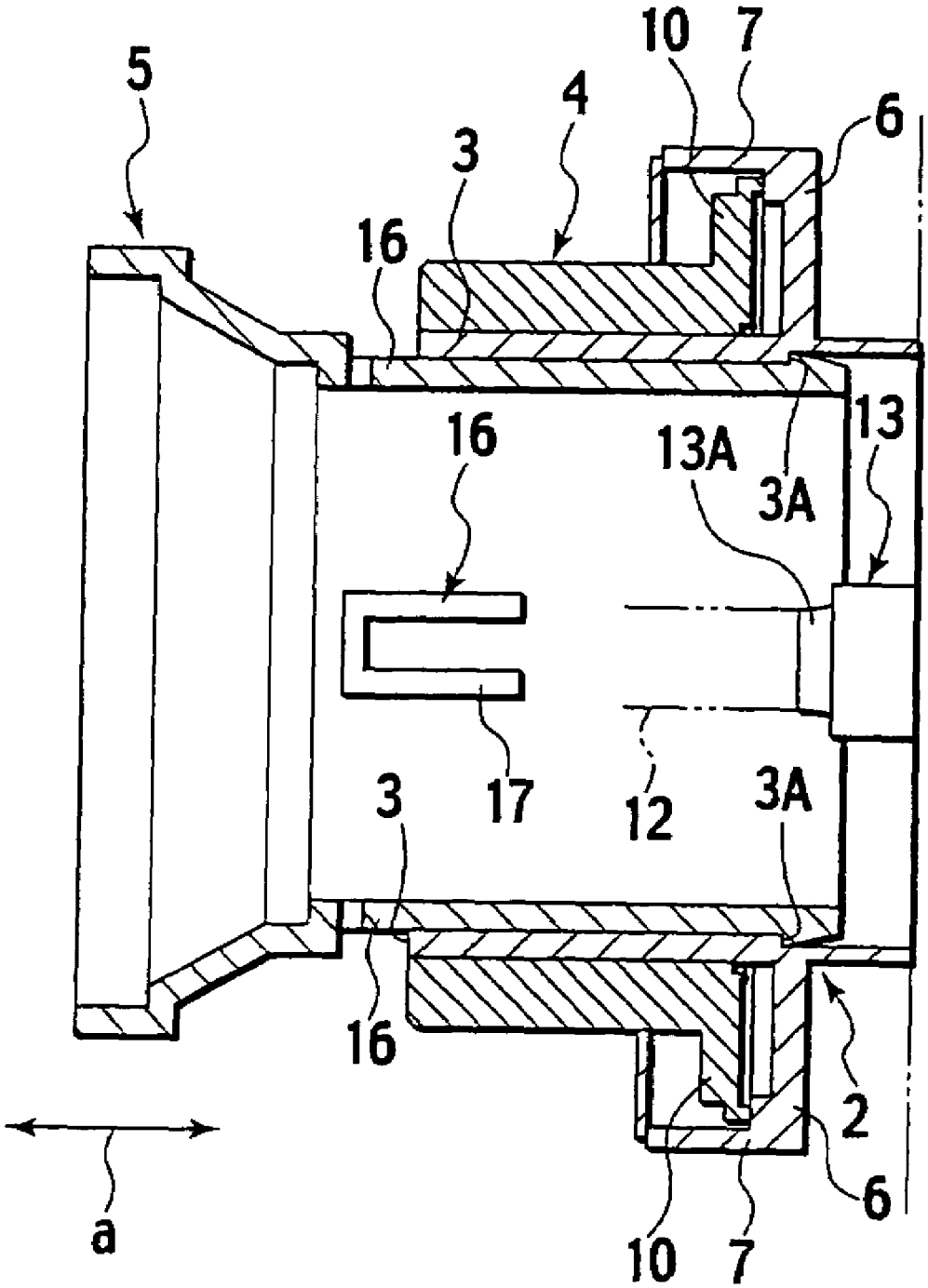
FIG. 2 is a cross sectional view of essential members of the push button switch.

A push button switch 1 for a vehicle according to the present embodiment is provided with a substantially cylindrical fixed portion 2 having a cylinder portion 3, a rotary switch 4 and a button portion 5 as shown in FIG. 1. The fixed portion 2 is fixed to a subject for installation such as a vehicle body or an auxiliary component of the vehicle. FIG. 1 shows that the fixed portion 2 is fixed to a substrate 8 and a support body 9, both of which are elements of the subject for installation.

Throughout the description, "distal" and "proximal" are respectively defined as remote and proximate to the subject for installation and, more specifically, "distal" and "proximal" are respectively drawn in the left and the right in FIG. 1.

The rotary switch 4 is rotatably fitted around the cylinder portion 3. The button portion 5 is slidably fitted in the interior of the cylinder portion 3 and hence slidable in a direction which is indicated by an arrow a of FIG. 1. The button portion 5 is prevented from rotation with respect to the cylinder portion 3.

A flange portion 6 circumferentially projects outward from a proximal portion of the cylinder portion 3. A rim of the flange portion 6 is provided with a circumferential wall 7 formed in a unitary body and projecting toward the distal direction. Wiring (not shown) for controlling the auxiliary component are disposed on the flange portion 6.

A slider flange 10, which has a smaller diameter than the flange portion 6, circumferentially projects outward from a proximal end of the rotary switch 4. A contact (not shown) is fixed on a proximal surface of the slider flange 10 so as to slide on the wiring on the flange portion 6. The contact is utilized for detecting resistance change between the contact and the wiring for instance. The rotary switch is further provided with anti-displacement means (not shown) for preventing falling off from the cylinder portion 3.

Inner surface of the cylinder portion 3 is provided with guiding slots 11 extending linearly along an axial direction. The guiding slots 11 slidably engage with sliding rails 14 of the button portion 5 (described later) so as to guide slide movement thereof. The inner surface of the cylinder portion 3 has at least three guiding slots 11. The inner surface of the cylinder portion 3 is further provided with latching steps 3A for engaging with latching projections 15 of the button portion 5 (described later).

Figure 3:
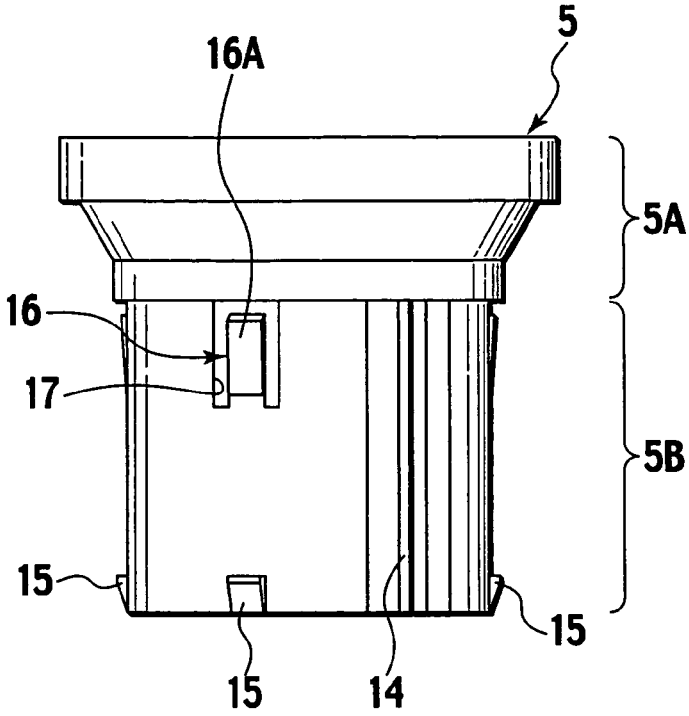
FIG. 3 is a side view of a button portion of the push button switch.
Figure 4:
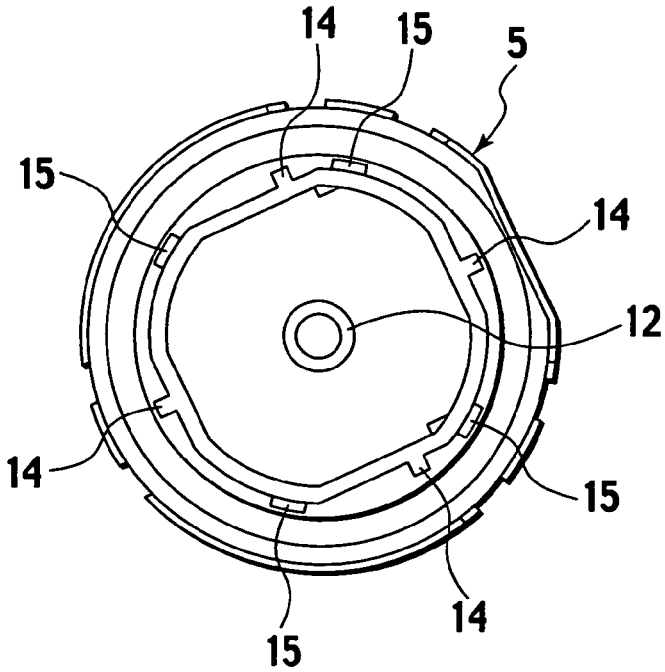
FIG. 4 is a rear view of the button portion of the push button switch.

The button portion 5 is provided with a button top 5A and a cylinder body 5B formed in a unitary body as shown in FIGS. 3 and 4. The button portion 5 is further provided with a plunger 12 at an axial center thereof and axially projecting toward the proximal direction for pressing a tact switch 13 mounted on the substrate 8. Thereby, in a case where the button top 5A is pushed, the tact switch 13 is switched on via the plunger 12.

A circumferential surface of the cylinder body 5B is provided with sliding rails 14, correspondingly to the guiding slots 11 of the cylinder portion 3, and the latching projections 15 at a distal end thereof, correspondingly to the latching steps 3A of the cylinder portion 3. The sliding rails 14 respectively slidably engage with the guiding slots 11. The latching projections 15 respectively engage with the latching steps 3A in a state that the button portion 5 is projected (not pushed) and prevents the button portion 5 from being displaced from the cylinder portion 3. Meanwhile, a button top 13A of the tact switch 13 has built-in repulsion means which gives a repulsive force to the button top 13A and the button portion 5 receives the repulsive force via the button top 13A. Therefore the button portion 5 is constantly urged toward the distal direction and the latching projections 15 are forced to engage with the latching steps 3A in a state that the button portion 5 is not pushed.

The circumferential surface of the cylinder body 5B is further provided with resilient pieces 16 at a distal end thereof. The resilient pieces 16 and the latching projections 15 are respectively aligned along a sliding direction of the button portion 5. Moreover, the resilient pieces 16 are respectively opposite to the latching projections 15 on the circumferential surface. The resilient pieces 16 are formed integrally with the circumferential surface at proximal ends thereof and obliquely project toward the distal end of the cylinder body 5B. Thereby the resilient pieces 16 respectively have sloping surfaces 16A oblique with respect to the circumferential surface. Free ends thereof are disposed at the side of the button top 5A. Grooves 17 respectively enclose the resilient pieces 16 except for the proximal end thereof.

A cylindrical knob portion 18 is fitted around the rotary switch 4. A cylindrical casing 19 is installed on the substrate 8 so as to enclose almost proximal half of the push button switch 1. Thereby the push button switch 1 is constituted.

Figure 5:
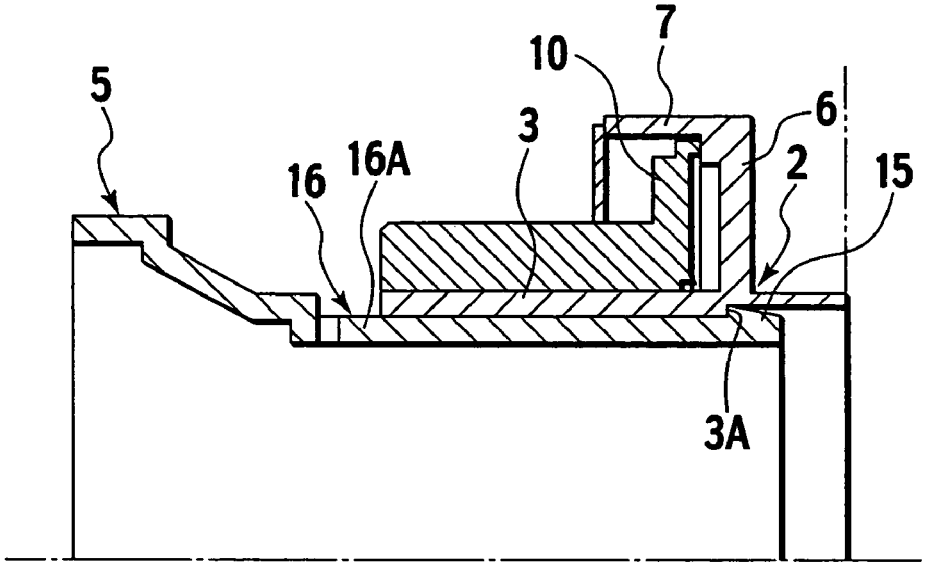
FIG. 5 is a cross sectional view corresponding to FIG. 2 in a state that the push button switch is not pushed.
Figure 6:
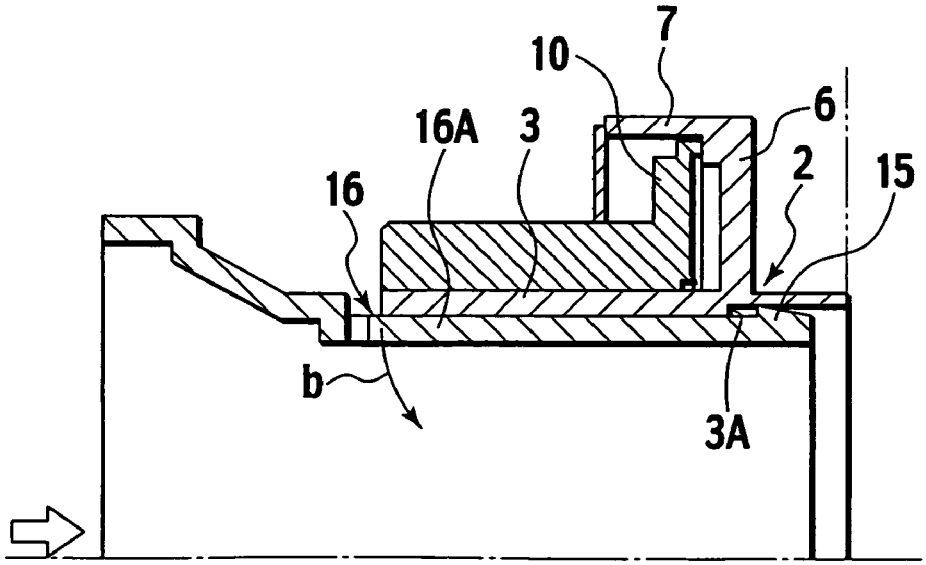
FIG. 6 is a cross sectional view corresponding to FIG. 2 in a state that the push button switch is pushed.

The resilient pieces 16 are disposed axially symmetrically as shown FIG. 3 and symmetrically press the inner surface of the cylinder portion 3 by repulsive force thereof as shown in FIG. 5. Thereby, the button portion 5 is centered with respect to the cylinder portion 3 and prevented from unsteadiness when the button portion 5 is not pushed. The cylinder portion 3 give force to the sloping surfaces 16A in a direction b as shown in FIG. 6. The force prevents unsteadiness of the button portion 5 in the course of pushing. More specifically, the resilient pieces 16 prevent unsteadiness of the button portion in both the sliding direction and the swinging direction.

Moreover, the resilient pieces 16 and the latching projections 15 catch the cylinder portion 3 from both ends. Thereby, the resilient pieces 16 and the latching projections 15 position the button portion 5 in a regular position with respect to the cylinder portion 3 without the repulsive force of the tact switch 13.

According to such configured push button switch 1, unsteadiness of the button portion 5 is effectively prevented in any directions of axial, radial, rotational directions. Therefore, dimensional tolerance particularly about the guiding slots 11 and the sliding rails 14 is not necessary to be strictly regulated for preventing unsteadiness. Accuracy of machining can be reasonably relieved.

Since the button portion 5 is regularly positioned without the repulsive force of the tact switch 13, dimensional tolerance with respect to the tact switch 13 and the plunger 12 of the button portion 5 can be also relieved. It is not necessary to give relatively strong repulsive force to the tact switch 13.

Furthermore, since the button portion 5 is properly centered with respect to the cylinder portion 3 when the button portion 5 is projected (not pushed), the button portion 5 provides a good appearance.

Alternatively to the embodiment described above, in which the resilient pieces 16 are formed on the circumferential surface of the cylinder body 5B, the resilient pieces 16 may be formed on the inner surface of the cylinder portion 3. Such modification provides the same effect as the aforementioned embodiment.

Although the invention has been described above by reference to certain embodiment of the invention, the invention is not limited to the embodiment described above. Modifications and variations of the embodiment described above will occur to those skilled in the art, in light of the above teachings.

What is claimed is:

1. A push button switch for a vehicle, comprising:

a cylinder portion;

a button portion slidably fitted in the cylinder portion; and one or more resilient pieces interposed between an inner surface of the cylinder portion and an outer circumferential surface of the button portion, the resilient pieces being configured to prevent unsteadiness of the button portion in a sliding direction and a swinging direction.

2. The push button switch of claim 1, wherein the button portion comprises one or more latching projections at a proximal end, the latching projections being configured to engage with the inner surface of the cylinder portion.

3. A push button switch for a vehicle, comprising:

a cylinder portion;

a button portion slidably fitted in the cylinder portion; and one or more resilient pieces interposed between an inner surface of the cylinder portion and a circumferential surface of the button portion, the resilient pieces being configured to prevent unsteadiness of the button portion in a sliding direction and a swinging direction, wherein the resilient pieces are formed on the circumferential surface of the button portion and respectively comprise sloping surfaces configured to slide on the inner surface of the cylinder portion and center the button portion with respect to the cylinder portion.

4. The push button switch of claim 3, wherein the button portion comprises one or more latching projections at a proximal end, the latching projections being configured to engage with the inner surface of the cylinder portion.

5. The push button switch of claim 4, wherein the resilient pieces and the latching projections are respectively aligned along the sliding direction of the button portion.

6. A push button switch for a vehicle, comprising:

a cylinder portion;

a button portion slidably fitted in the cylinder portion and one or more resilient pieces interposed between an inner surface of the cylinder portion and a circumferential surface of the button portion, the resilient pieces being configured to prevent unsteadiness of the button portion in a sliding direction and a swinging direction.

wherein the button portion comprises one or more latching projections at a proximal end, the latching projections being configured to engage with the inner surface of the cylinder portion, and wherein the resilient pieces and the latching projections are respectively aligned along the sliding direction of the button portion.

7. The push button switch of claim 6, wherein the resilient pieces are formed on the circumferential surface of the button portion and respectively comprise sloping surfaces configured to slide on the inner surface of the cylinder portion and center the button portion with respect to the cylinder portion.

* * * * *